US012636757B2

(12) United States Patent
Cauley, Jr. et al.

(10) Patent No.: US 12,636,757 B2
(45) Date of Patent: May 26, 2026

(54) SHARPENING DEVICE

(71) Applicant: AOB Products Company, Columbia, MO (US)

(72) Inventors: Dennis W. Cauley, Jr., Fayette, MO (US); James Tayon, Moberly, MO (US); Anthony Vesich, Columbia, MO (US); Matthew Kinamore, Columbia, MO (US); Curtis Smith, Columbia, MO (US); Josh Neville, Columbia, MO (US); Mark Dalton, Columbia, MO (US)

(73) Assignee: AOB Products Company, Columbia, MO (US)

( * ) Notice: Subject to any disclaimer, the term of this patent is extended or adjusted under 35 U.S.C. 154(b) by 0 days.

(21) Appl. No.: 18/098,256

(22) Filed: Jan. 18, 2023

(65) Prior Publication Data

US 2023/0150093 A1 May 18, 2023

Related U.S. Application Data

(62) Division of application No. 17/126,242, filed on Dec. 18, 2020, now Pat. No. 11,565,375.

(60) Provisional application No. 62/949,725, filed on Dec. 18, 2019.

(51) Int. Cl.
*B24D 15/08* (2006.01)

(52) U.S. Cl.
CPC ..... *B24D 15/08* (2013.01)

(58) Field of Classification Search
CPC ..... B24D 15/06; B24D 15/063; B24D 15/08; B24D 15/081; B24D 15/082; B24D 15/084; B24D 15/085; B24B 3/36; B24B 3/52; B24B 3/54; B24B 3/543; B24B 3/605
USPC ..... 451/552; 76/86
See application file for complete search history.

(56) References Cited

U.S. PATENT DOCUMENTS

| | | | | |
|---|---|---|---|---|
| 538,404 | A * | 4/1895 | Benesh | B24D 15/081 76/86 |
| 1,165,245 | A | 12/1915 | Goodwin | |
| 1,429,984 | A | 9/1922 | Vollmer | |
| 2,462,176 | A * | 2/1949 | Fryar | B24D 15/06 451/486 |
| 2,674,072 | A | 4/1954 | Lohmann | |
| 3,894,362 | A | 7/1975 | Graves | |
| 4,231,194 | A | 11/1980 | Glesser | |

(Continued)

FOREIGN PATENT DOCUMENTS

| | | | |
|---|---|---|---|
| CN | 104552040 | A | 4/2015 |
| KR | 20100123284 | A | 11/2010 |

OTHER PUBLICATIONS

U.S. Pat. No. 462,001, Issued Oct. 27, 1891, C.F. Foster et al.

*Primary Examiner* — Brian D Keller
*Assistant Examiner* — Sidney D Full
(74) *Attorney, Agent, or Firm* — Stinson LLP

(57) ABSTRACT

A sharpening device, components thereof, and associated methods. The sharpening device includes a sharpening assembly and a housing. The sharpening assembly is selectively receivable in the housing in a stowed configuration and supportable by the housing in an operational configuration to support the sharpening assembly for sharpening a blade. The sharpening assembly can include first and second arms having respective abrasive sharpening surfaces pivotable away from each other about a pivot connection.

45 Claims, 4 Drawing Sheets

(56) References Cited

U.S. PATENT DOCUMENTS

| | | | | |
|---|---|---|---|---|
| 4,259,815 | A | 4/1981 | Kuban | |
| 4,640,058 | A | 2/1987 | Glesser | |
| 4,646,477 | A | 3/1987 | Robertson | |
| D326,989 | S | 6/1992 | Button et al. | |
| D327,402 | S | 6/1992 | Button et al. | |
| D328,847 | S | 8/1992 | Button et al. | |
| 5,440,953 | A | 8/1995 | Gangelhoff et al. | |
| 5,477,753 | A | 12/1995 | Branscum et al. | |
| 6,168,509 | B1 | 1/2001 | Presgrove | |
| 6,726,551 | B2 | 4/2004 | Friel, Sr. | |
| 6,881,137 | B2 | 4/2005 | Friel, Sr. | |
| D513,955 | S | 1/2006 | Friel, Sr. | |
| 8,951,098 | B2 | 2/2015 | Jhones | |
| 9,039,494 | B1 * | 5/2015 | Dovel | B24D 15/08 76/82 |
| 9,796,068 | B2 | 10/2017 | Jhones | |
| 9,821,436 | B1 | 11/2017 | Smith | |
| 11,253,968 | B2 * | 2/2022 | Chalfant | B24D 15/08 |
| 2009/0088057 | A1 | 4/2009 | Smith | |
| 2009/0156103 | A1 | 6/2009 | Henry | |
| 2009/0275272 | A1 * | 11/2009 | Bonapace | B24D 15/082 51/293 |
| 2014/0154963 | A1 | 6/2014 | Jhones | |
| 2015/0128427 | A1 | 5/2015 | Linn et al. | |

* cited by examiner

SHARPENING DEVICE

CROSS-REFERENCE TO RELATED APPLICATIONS

The present application is a divisional of U.S. patent application Ser. No. 17/126,242, filed Dec. 18, 2020, now U.S. Pat. No. 11,565,375, which claims priority to U.S. Provisional Patent App. No. 62/949,725, filed Dec. 18, 2019, the entireties of which are hereby incorporated by reference.

FIELD

The present disclosure generally relates to sharpeners and more particularly to blade sharpeners such as used for sharpening knife blades, scissor blades, and the like.

BACKGROUND

After a knife has been used for some time, a cutting edge of the knife usually becomes dull. The cutting edge can be sharpened using a sharpener.

SUMMARY

In one aspect, a blade sharpening device comprises a first support including a first arm, a second arm, and a first pivot hub. The first and second arms extend away from the first pivot hub in different directions. The first and second arms include respective first and second abrasive sharpening surfaces for sharpening the blade. The blade sharpening device includes a second support including a third arm, a fourth arm, and a second pivot hub. The third and fourth arms extend away from the second pivot hub in different directions. The third and fourth arms include respective third and fourth abrasive sharpening surfaces for sharpening the blade. A pivot connection connects the first and second pivot hubs. The first and second supports are pivotable about the pivot connection to pivot the first and second arms away from each other and pivot the third and fourth arms away from each other to configure the first and second supports in an operational configuration for use in sharpening the blade.

In another aspect, a blade sharpening device for sharpening a blade comprises a housing defining an interior. The housing includes an opening permitting access to the interior. The housing includes at least one receiver different from the opening. The blade sharpening device includes a blade sharpening assembly. The blade sharpening assembly includes first and second arms connected by a pivot connection about which the first arm is pivotable with respect to the second arm. The first and second arms include respective first and second abrasive sharpening surfaces for sharpening the blade. The blade sharpening assembly is configurable in a stowed configuration in which the arms extend alongside each other. The blade sharpening assembly is configurable in an operational configuration in which the arms are pivoted away from each other to present the abrasive sharpening surfaces for use in sharpening the blade. The blade sharpening assembly in the stowed configuration is receivable in the interior of the housing from the opening to arrange the housing and blade sharpening assembly in a stowed arrangement. The blade sharpening assembly in the operational configuration is receivable in the at least one receiver to arrange the housing and blade sharpening assembly in an operational arrangement in which the housing serves as a base to support the blade sharpening assembly extending upward from the housing for use of the first and second abrasive sharpening surfaces to sharpen the blade.

Other objects and features of the present disclosure will be in part apparent and in part pointed out herein.

BRIEF DESCRIPTION OF THE DRAWINGS

Corresponding reference numbers indicate corresponding parts throughout the drawings.

DETAILED DESCRIPTION

Figure 1:
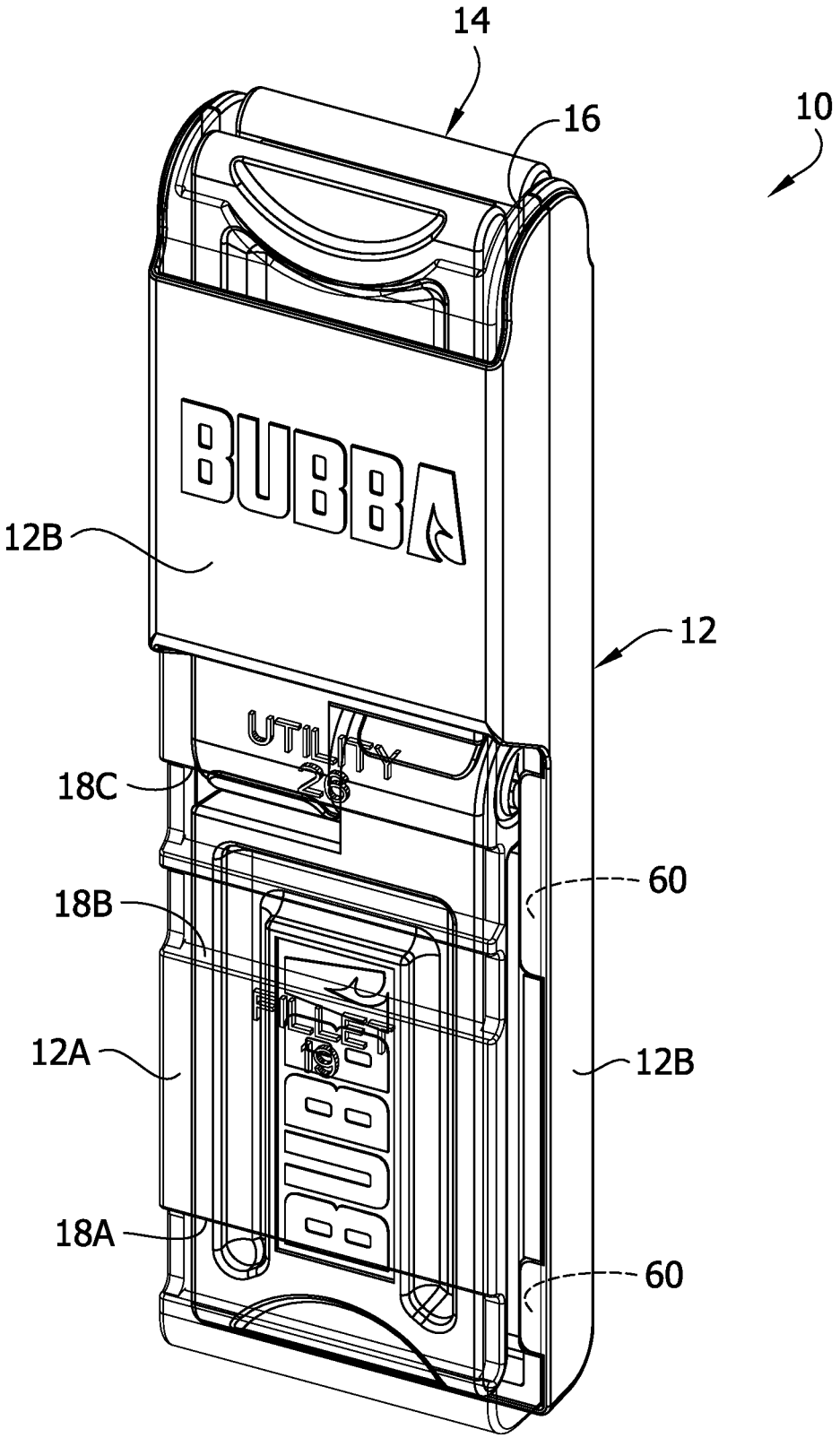
FIG. 1 is a perspective of a blade sharpening device of the present disclosure in a stowed arrangement.
Figure 2:
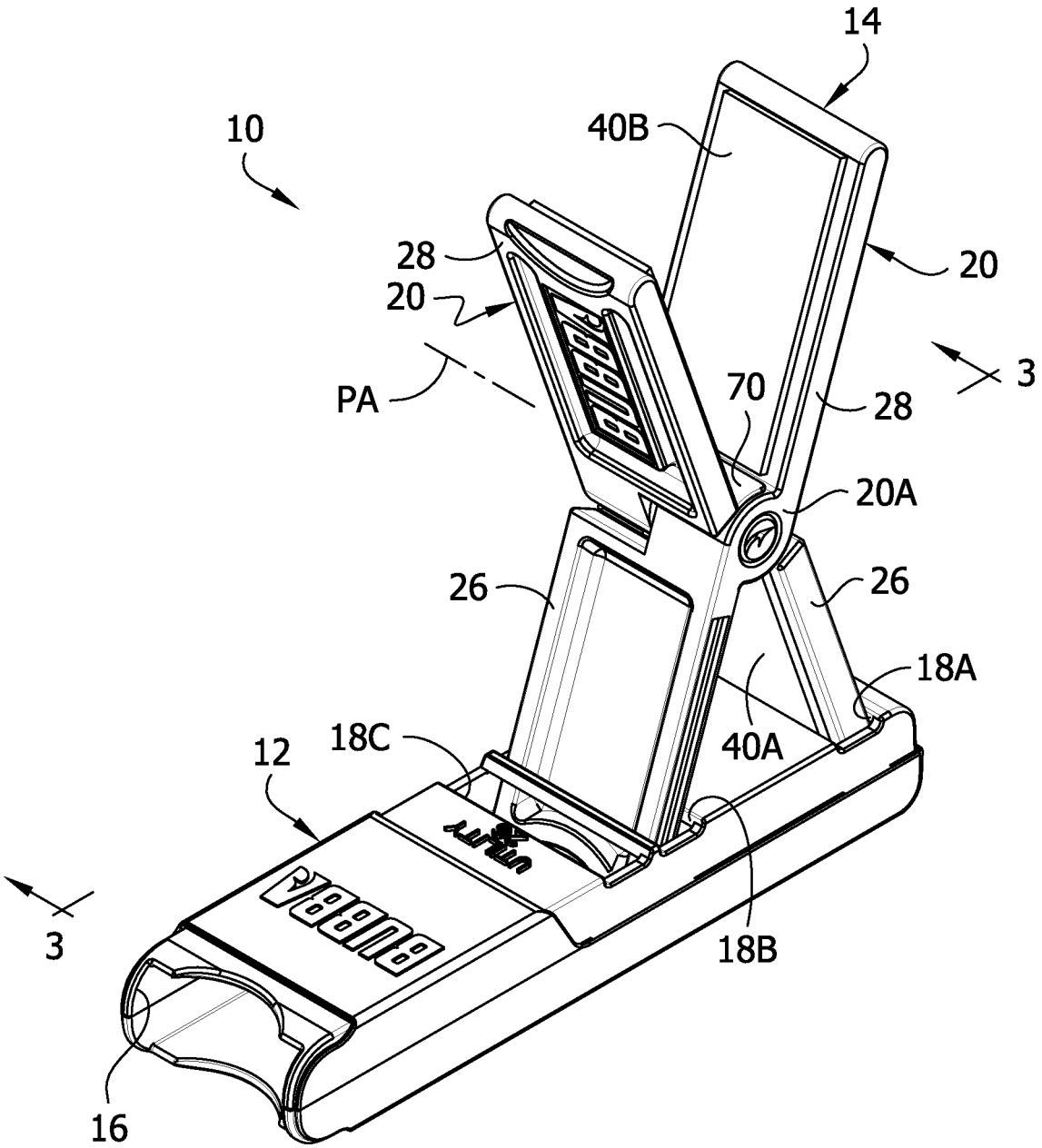
FIG. 2 is a perspective of the blade sharpening device of the present disclosure in an operational arrangement.
Figure 3:
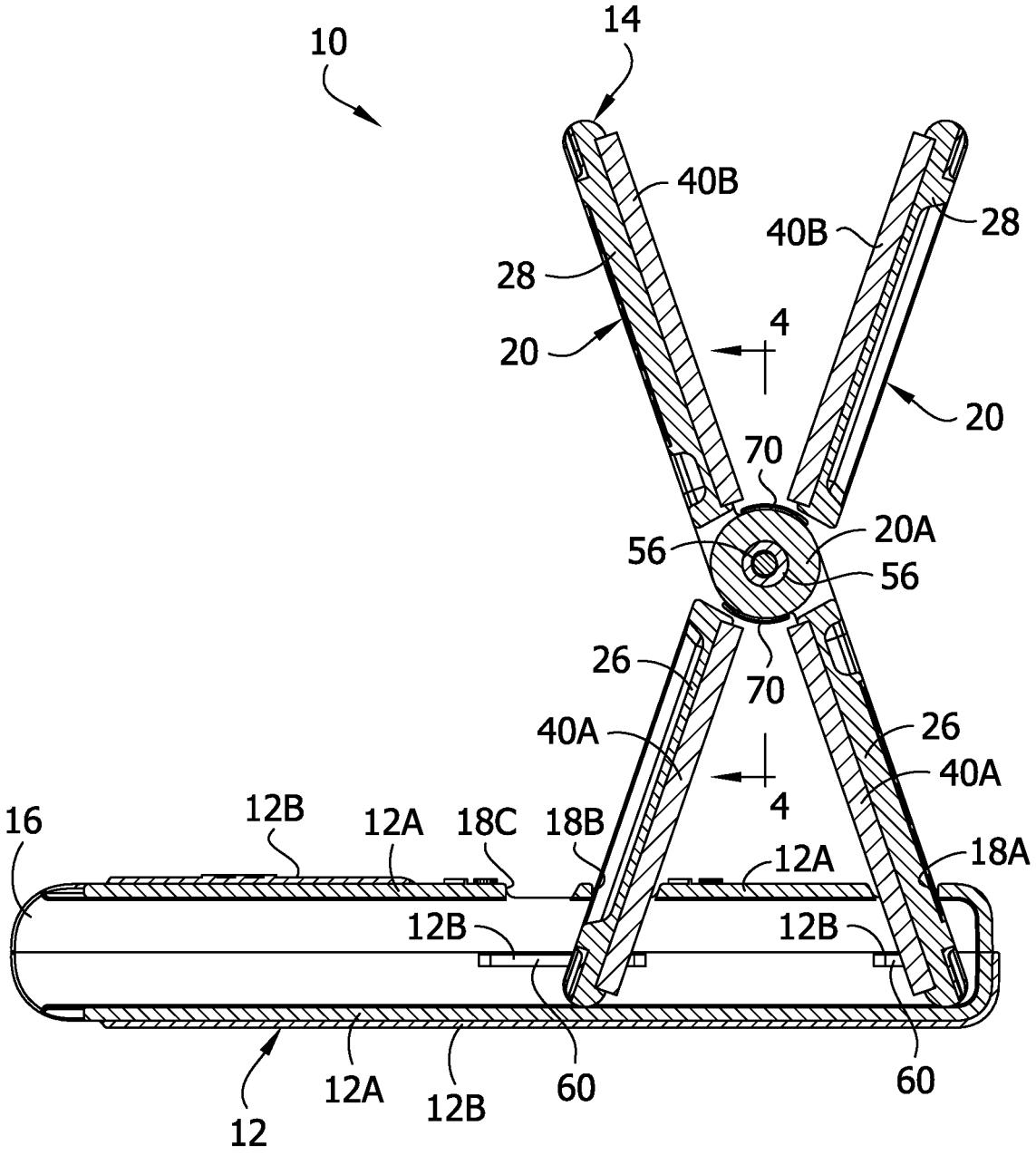
FIG. 3 is a section of the blade sharpening device taken in a plane including line 3-3 of FIG. 2.
Figure 4:
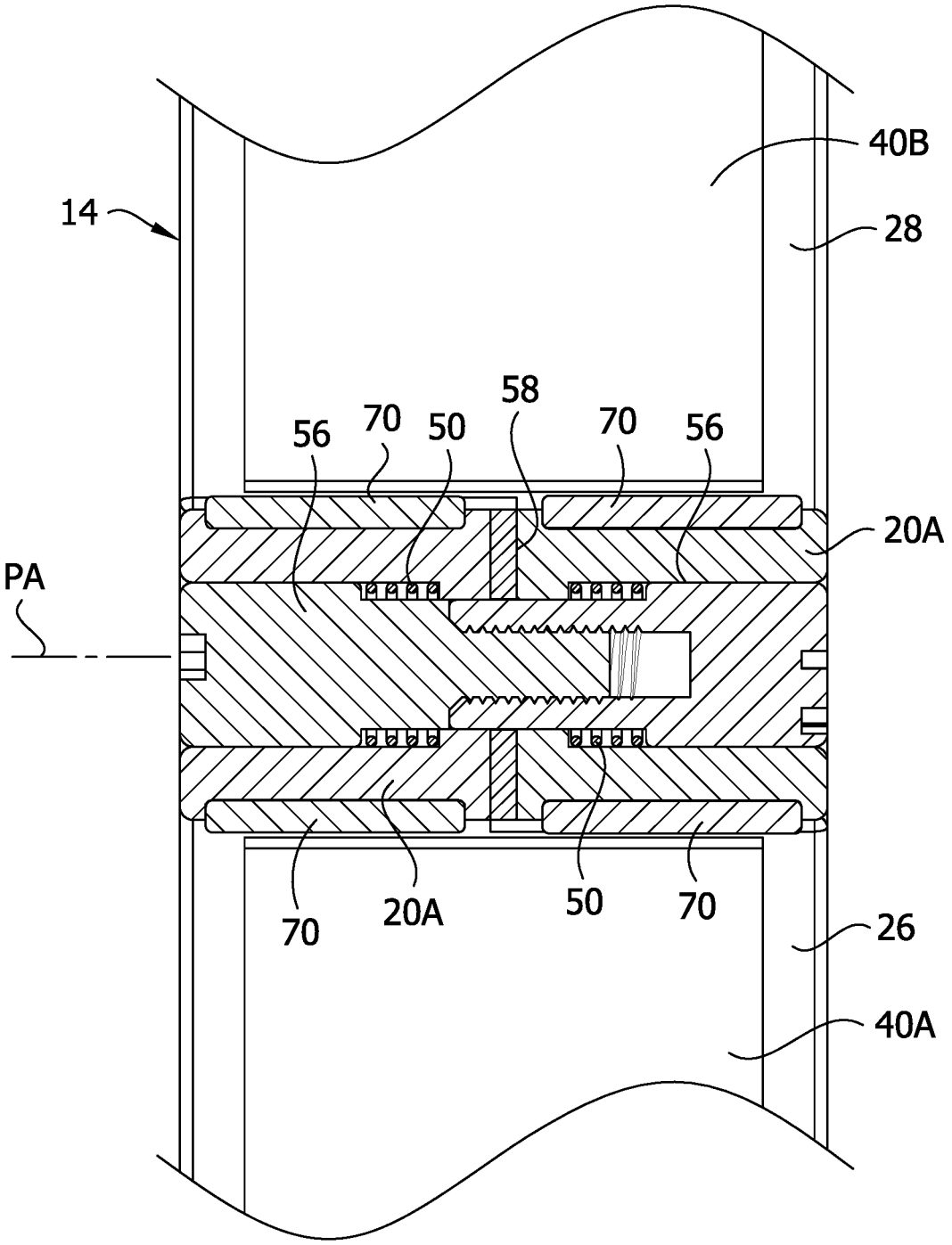
FIG. 4 is a fragmentary section of the blade sharpening device taken in a plane including line 4-4 of FIG. 3.

Referring to FIGS. 1 and 2, a blade sharpening device of the present disclosure is indicated by 10. The blade sharpening device can be used to sharpen various types of blades, such as knife blades and scissor blades, or to sharpen other objects. The blade sharpening device 10 includes a housing 12, which may also be referred to as a base. The blade sharpening device 10 also includes a blade sharpener assembly 14. In a stowed arrangement (e.g., FIG. 1), the blade sharpener assembly 14 is stored in the housing 12, and in an operational configuration (e.g., FIG. 2) the blade sharpener assembly is supported by the housing as a base for use of the blade sharpener in sharpening a blade. The housing 12 defines an interior in which the blade sharpening assembly 14 is receivable via an end opening 16 in the housing to form the stowed arrangement, and the housing includes receivers 18A-18C for receiving and supporting the blade sharpening assembly in the operational arrangement.

The blade sharpening assembly 14 includes a first support 20 and a second support 20. The first and second supports 20 include respective pivot hubs 20A connected to each other by a pivot connection defining a pivot axis PA. The first support 20 includes first and second arms 26, 28 extending in opposing directions away from the pivot connection. Likewise, the second support 20 includes first and second arms 26, 28 extending in opposing directions away from the pivot connection. The arrangement is such that the first arms 26 of the first and second supports 20 form a first pair of arms and the second arms 28 of the first and second supports form a second pair of arms. The pairs of arms 26, 28 are movable toward and away from each other in a scissors fashion by pivoting one or both of the supports 20 about the pivot connection. The blade sharpening assembly 14 is configurable in a stowed configuration by pivoting one or both of the supports 20 about the pivot connection to arrange the respective arms 26, 28 of each pair of arms alongside each other. The blade sharpening assembly 14 is configurable in the operational configuration by pivoting the supports 20 to move the respective arms 26, 28 of each pair of arms away from each other. In the operational configurations, the supports 20 form a generally X shape.

Blade sharpeners 40A, 40B are provided on the arms 26, 28 for sharpening opposite sides of a blade. In the illustrated embodiment, the sharpeners 40A, 40B comprise rectangular sharpening stones that have generally planar abrasive sharpening surfaces. Other types of sharpeners can be used without departing from the scope of the present disclosure. The abrasive sharpening surfaces of the sharpeners 40A on the first pair of arms 26 have a first grit (e.g., coarse grit, such as 400 grit), and the abrasive sharpening surfaces of the sharpeners 40B on the second pair of arms 28 have a second grit (e.g., fine grit, such as 800 grit). For example, the sharpeners 40A on the first set of arms 26 may be used in a first stage of sharpening, and the sharpeners 40B on the second pair of arms 28 may be used in a second stage of sharpening. When in the stowed configuration, the abrasive sharpening surfaces of the respective pairs sharpeners 40A, 40B are immediately adjacent or abutting each other (e.g., in generally flatwise engagement with each other).

It will be appreciated that the supports 20 are configured to permit a compact stowed configuration in which the arms 26, 28 of each pair of arms extend alongside each other, with the abrasive sharpening surfaces opposing each other and being close to each other. In one aspect, arms 26, 28 of one support 20 are located on opposite sides of a reference plane that includes the pivot axis PA and that extends parallel to a length of an abrasive sharpening surface of one of the arms 26, 28. This arrangement results from the arms 26, 28 of a support 20 extending in an offset manner with respect to each other from the pivot hub to which the arms are connected. The construction permits the abrasive sharpening surfaces to be essentially in flatwise face-to-face engagement when the assembly 14 is in the stowed configuration. It will be appreciated as well that the pivot hub 20A of one support 20 is located in a gap of the other support between proximal ends of the other support's arms 26, 28. The pivot hubs 20A are narrower than the arms 26, 28, and the pivot hubs have a combined width about the same as the width of the arms 26, 28.

The base 12 has an elongate shape and includes a lower portion configured to rest on a support surface and an upper portion including the plurality of receivers 18A-18C. The receivers 18A-18C are sized and shaped to receive arms 26, 28 of the blade sharpening assembly 14 to support the blade sharpening assembly in the operational configuration. Depending on whether the user would like to use the first or second pair of sharpeners 40A, 40B, the user can select which pair of arms 26, 28 is installed in the receivers 18A-18C. In the illustrated embodiment, three receivers 18A-18C are provided. Each receiver 18A-18C comprises an opening permitting access into the interior of the base 12. When the blade sharpening assembly 14 is in a receiver 18A-18C in the operational arrangement, the blade sharpening assembly extends into the interior and occupies a portion of the interior that is occupied by the blade sharpening assembly in the stowed arrangement. In a first operational arrangement of the base 12 and assembly 14, arms 26 or 28 of the blade sharpening assembly 14 are received in the first and second receivers 18A, 18B, and in a second operational arrangement, arms 26 or 28 of the blade sharpening assembly are received in the first and third receivers 18A, 18C. The first and second receivers 18A, 18B are arranged such that when the blade sharpening assembly is in the first operational configuration, the abrasive sharpening surfaces of the upper pair of sharpeners 40B are oriented at a first angle (e.g., 19 degrees) with respect to vertical. The first and third receivers 18A, 18C are arranged such that when the blade sharpening assembly is in the second operational configuration the abrasive sharpening surfaces are oriented at a second angle (e.g., 26 degrees) with respect to vertical (greater than the first angle). For example, it may be desirable to sharpen fillet knives using the first operational configuration and to sharpen utility knives or multi-purpose knives using the second operational configuration. Other numbers of operational configurations can be used (e.g., one, three, etc.) can be used without departing from the scope of the present disclosure.

Optionally, the blade sharpening assembly 14 can be configured to prevent the supports 20 from freely pivoting about the pivot connection (e.g., "flopping" open or closed). For example, the supports 20 can be frictionally prevented from freely pivoting about the pivot connection except in response to manual force applied by a user. The blade sharpening assembly 14 can include a pivot damper configured to apply friction to the first and second supports 20 to dampen pivoting movement. In the illustrated embodiment, pivot hubs 20A of the supports 20 are pivotally connected by fasteners 56 threaded to each other, and a washer 58 is provided between the pivot hubs. The pivot damper comprises two compression springs 50 captured between the supports 20 and the fasteners 56. The pivot axis PA of the pivot connection passes through the springs 50. The springs 50 are received over the fasteners 56. First ends of the springs press against pivot hubs 20A of the supports 20, and opposing ends of the springs press against the fasteners 56. The compression of the springs 50 causes the springs to apply a frictional force against the supports 20 at the pivot hubs 20A to prevent gravitational pivoting of the supports and to require manually applied force to pivot the supports about the pivot connection. The compression of the springs 50 and thus the friction applied by the springs (and the force required to pivot the supports 20) can be adjusted by changing the amount the fasteners 56 are tightened to draw heads of the fasteners toward each other. The pivot damper may also be referred to as a retainer which retains the supports in the operational and/or stowed configuration and permits pivoting of the supports under manual pressure applied by a user.

It will be appreciated that the blade sharpening assembly 14 can be supported by the base 12 in the operational configuration with either the first pair of arms 26 extending upward for sharpening with the first pair of sharpeners 40A, or the second pair of arms 28 extending upward for sharpening with the second pair of sharpening stones 40B. The blade sharpening assembly 14 is inverted to present the first or second pair of sharpeners 40A, 40B for use.

To sharpen the blade, the blade is moved downward along the opposing abrasive sharpening surfaces of the upper sharpeners 40B in an alternating fashion to sharpen opposite sides of the blade to form a desired cutting edge. More specifically, the blade can be sharpened by, while holding the knife with the longitudinal axis of the blade extending generally horizontally, with the cutting edge pointing downward and the blade extending vertically from the cutting edge to a back edge of the blade, moving the cutting edge downward across the abrasive sharpening surfaces, alternating between the opposite abrasive sharpening surfaces to sharpen both sides of the cutting edge. Depending on whether the first or second operational configuration is being used, the edge margins of the blade adjacent the cutting edge become beveled at an angle corresponding to the angle of the abrasive sharpening surfaces with respect to vertical. In one method, the blade sharpening assembly 14 is arranged in the selected first or second configuration with the coarse sharpeners 40A to create a coarse bevel at the edge margin adjacent the cutting edge. Then the blade sharpening assembly 14 is flipped over and reinstalled in the base in the same first or second configuration but with the fine sharpeners 40B on top. The fine sharpeners 40B are used in a similar alternating downward strokes on the opposite fine abrasive sharpening surfaces to create a smoother bevel surface at generally the same bevel angle as the coarse bevel, to complete sharpening of the blade.

In another aspect, the housing 12 includes grips 60 to grip the blade sharpening assembly 14 when the blade sharpening assembly is received in the receivers 18A-18C in an operational configuration and to grip the blade sharpening assembly when in the interior of the housing in the stowed configuration. In the illustrated embodiment, the main body 12A of the housing or base 12 is made of plastic material that has a relatively low coefficient of friction. A layer of polymeric material 12B is overmolded onto the main body of the housing 12. The grips 60 are formed by portions of the polymeric material 12B overmolded onto the main body 12A and are exposed in and protrude into the interior of the housing 12. The grips 60 frictionally engage opposing portions of the blade sharpening assembly 12 when the blade sharpening assembly is received in the receivers 18A-18C in the operational configuration and in the housing interior in the stowed configuration. Desirably, the grips 60 provide a tolerance or friction fit with the blade sharpening assembly 14 in the operational and stowed configurations. In the illustrated embodiments, the same grips 60 are used to frictionally engage the blade sharpening assembly in operational and stowed configurations. As a user inserts the arms 26, 28 of the blade sharpening assembly into the receivers 18A-18C or inserts the collapsed blade sharpening assembly 14 into the interior of the housing via the end opening 16, the blade sharpening assembly becomes lodged between opposing grips 60. The grips 60 hold the blade sharpening assembly in position with respect to the housing or base 12 in the operational and stowed configurations. The user can overcome the frictional engagement of the blade sharpening assembly 14 and grips 60 by applying sufficient pulling force to remove the blade sharpening assembly from the receivers 18A-18C or housing interior. The grips 60 facilitate formation of a stable foundation for the blade sharpening assembly 14 with the base 12 when the blade sharpening assembly is received in the receivers 18A-18C in the operational configuration and prevent the blade sharpening assembly from inadvertently exiting the housing when in the stowed configuration.

In yet another aspect, the blade sharpening assembly 14 includes pivot connection structure configured to not damage the cutting edge of the knife blade if the pivot connection structure is unintentionally struck by the cutting edge during sharpening. In particular, the first and second supports 20 include the pivot hubs 20A at which the supports are pivotally connected by the fasteners 56. When the blade sharpening assembly 14 is in an operational position, the hubs 20A define a bottom of a generally V shape formed by the upper arms 28. As the knife blade is moved downward along an abrasive sharpening surface of a sharpener 40B, the user should stop short of the pivot connection structure to avoid contacting the cutting edge of the blade with the pivot connection structure. However, the pivot connection structure includes shields 70 of protective material configured to be contacted by the cutting edge in case of accidental contact of the cutting edge with the pivot connection structure. Desirably, the protective material 70 is configured to be contacted by the blade without substantially dulling or harming the cutting edge. Desirably, the protective material 70 is softer than the material from which the supports 20 are constructed. For example, the supports 20 may be formed of metal (e.g., aluminum), and the protective material 70 can comprise a polymeric material (e.g., synthetic rubber) overmolded onto the supports.

It will be apparent that modifications and variations are possible without departing from the scope of the invention defined in the appended claims.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A blade sharpening device for sharpening a blade, the sharpening device comprising:

a first arm;

a first abrasive sharpener for sharpening the blade, the first abrasive sharpener being formed separately from and carried by the first arm;

a second arm;

a second abrasive sharpener for sharpening the blade, the second abrasive sharpener being formed separately from and carried by the second arm;

a third arm;

a third abrasive sharpener for sharpening the blade, the third abrasive sharpener being formed separately from and carried by the third arm;

a fourth arm;

a fourth abrasive sharpener for sharpening the blade, the fourth abrasive sharpener being formed separately from and carried by the fourth arm; and a pivot connection connecting the arms to each other, the pivot connection forming a pivot axis, the pivot connection permitting at least two of said arms to be pivotable about the pivot axis;

wherein the arms are arrangeable in a first operational configuration in which the second and fourth arms extend downward with respect to the pivot connection, the first and third arms extend upward with respect to the pivot connection, and the first and third arms define a first sharpening space therebetween including a first opening above the pivot connection, the first opening arranged to permit the blade to be moved downward through the first opening and into the first sharpening space;

wherein the arms are arrangeable in a second operational configuration in which the first and third arms extend downward with respect to the pivot connection, the second and fourth arms extend upward with respect to the pivot connection, and the second and fourth arms define a second sharpening space therebetween including a second opening above the pivot connection, the second opening arranged to permit the blade to be moved downward through the first opening and into the second sharpening space.

2. The blade sharpening device of claim 1, wherein in the first operational configuration the second and fourth arms extend away from each other.

3. The blade sharpening device of claim 2, wherein in the second operational configuration the first and third arms extend away from each other.

4. The blade sharpening device of claim 1, wherein the arms are configured to be arrangeable in the second operational configuration by arranging the arms in the first operational configuration and conjointly inverting the arms and the pivot connection.

5. The blade sharpening device of claim 1, wherein the first and third abrasive sharpeners bound the first sharpening space and the second and fourth abrasive sharpeners bound the second sharpening space.

6. The blade sharpening device of claim 1, wherein the arms are arrangeable in a stowed configuration in which the first and third arms extend alongside each other and in which the second and fourth arms extending alongside each other.

7. The blade sharpening device of claim 6, wherein the first and third arms lie against one another and the second and fourth arms lie against one another when the arms are in the stowed configuration.

8. The blade sharpening device of claim 6, wherein the first abrasive sharpener includes a first abrasive sharpening surface for sharpening the blade, the second abrasive sharpener includes a second abrasive sharpening surface for sharpening the blade, the third abrasive sharpener includes a third abrasive sharpening surface for sharpening the blade, and the fourth abrasive sharpener includes a fourth abrasive sharpening surface for sharpening the blade, wherein, when the arms are in the stowed configuration, the first and third abrasive sharpening surfaces engage one another and the second and fourth abrasive sharpening surfaces engage one another.

9. The blade sharpening device of claim 1, wherein the pivot connection includes a first pivot hub and a second pivot hub, the first and second arms being connected to the first pivot hub, and the third and fourth arms being connected to the second pivot hub.

10. The blade sharpening device of claim 9, wherein the first and second arms are configured to pivot conjointly with the first pivot hub about the pivot connection.

11. The blade sharpening device of claim 10, wherein the third and fourth arms are configured to pivot conjointly with the second pivot hub about the pivot connection.

12. The blade sharpening device of claim 1, further comprising a base configured to support the arms in the first operational configuration and in the second operational configuration.

13. The blade sharpening device of claim 1, wherein the pivot connection permits each of the first arm, the second arm, the third arm, and the fourth arm to be pivotable about the pivot axis.

14. The blade sharpening device of claim 1, wherein:

the first abrasive sharpener of the first arm is disposed on a side of the first arm that faces the third arm;

the second abrasive sharpener of the second arm is disposed on a side of the second arm that faces the fourth arm;

the third abrasive sharpener of the third arm is disposed on a side of the third arm that faces the first arm; and the fourth abrasive sharpener of the fourth arm is disposed on a side of the fourth arm that faces the second arm.

15. The blade sharpening device of claim 1, wherein:

in the first operational configuration, an angular distance about the pivot axis between the first and third abrasive sharpeners is less than an angular distance about the pivot axis between the first and third arms; and in the second operational configuration, an angular distance about the pivot axis between the second and fourth abrasive sharpeners is less than an angular distance about the pivot axis between the second and fourth arms.

16. The blade sharpening device of claim 1, wherein:

in the first operational configuration, the first and third abrasive sharpeners are located directly across the first sharpening space from one another; and in the second operational configuration, the second and fourth abrasive sharpeners are located directly across the second sharpening space from one another.

17. The blade sharpening device of claim 1, wherein the first abrasive sharpener includes a first abrasive sharpening surface for sharpening the blade, the second abrasive sharpener includes a second abrasive sharpening surface for sharpening the blade, the third abrasive sharpener includes a third abrasive sharpening surface for sharpening the blade, and the fourth abrasive sharpener includes a fourth abrasive sharpening surface for sharpening the blade;

wherein in the first operational configuration, a first circle with a center at the pivot axis intersects the first and third abrasive sharpening surfaces, the first circle intersecting the first abrasive sharpening surface at a location spaced from a perimeter of the first abrasive sharpening surface and intersecting the third abrasive sharpening surface at a location spaced from a perimeter of the third abrasive sharpening surface; and wherein in the second operational configuration, a second circle with a center at the pivot axis intersects the second and fourth abrasive sharpening surfaces, the second circle intersecting the second abrasive sharpening surface at a location spaced from a perimeter of the second abrasive sharpening surface and intersecting the fourth abrasive sharpening surface at a location spaced from a perimeter of the fourth abrasive sharpening surface.

18. The blade sharpening device of claim 1, wherein the first and third abrasive sharpeners are coarser than the second and fourth abrasive sharpeners.

19. The blade sharpening device of claim 1, wherein when the arms are in the first operational configuration the first abrasive sharpener is offset an angular distance about the pivot axis from the third abrasive sharpener, and wherein when the arms are in the second operational configuration the second abrasive sharpener is offset an angular distance about the pivot axis from the fourth abrasive sharpener.

20. The blade sharpening device of claim 19, wherein when the arms are in both the first and second operational configurations the first abrasive sharpener is offset an angular distance about the pivot axis from the second abrasive sharpener.

21. A blade sharpening device for sharpening a blade, the sharpening device comprising:

a first support having opposite first and second ends;

a second support having opposite first and second ends; and a pivot connection connecting the first and second supports, the pivot connection disposed between the first and second ends of the first support and between the first and second ends of the second support, the first and second supports being pivotable about the pivot connection to pivot the first and second supports relative to one another to arrange the first and second supports in an operational arrangement for use in sharpening the blade, wherein in the operational arrangement the first and second supports are arranged to form a generally X shape;

wherein the first support includes a first abrasive sharpening surface disposed between the pivot connection and the first end of the first support, and the second support includes a second abrasive sharpening surface disposed between the pivot connection and the first end of the second support, the first and second abrasive sharpening surfaces arranged to generally face one another when the first and second supports are in the operational arrangement;

wherein the first support includes a third abrasive sharpening surface disposed between the pivot connection and the second end of the first support, and the second support includes a fourth abrasive sharpening surface disposed between the pivot connection and the second end of the second support, the third and fourth abrasive sharpening surfaces arranged to generally face one another when the first and second supports are in the operational arrangement;

wherein the first and second abrasive sharpening surfaces are coarser than the third and fourth abrasive sharpening surfaces;

wherein in the operational arrangement a circle with a center defined by the pivot connection intersects the first, second, third and fourth abrasive sharpening surfaces, the circle intersecting the first abrasive sharpening surface at a location spaced from a perimeter of the first abrasive sharpening surface, the circle intersecting the second abrasive sharpening surface at a location spaced from a perimeter of the second abrasive sharpening surface, the circle intersecting the third abrasive sharpening surface at a location spaced from a perimeter of the third abrasive sharpening surface, the circle intersecting the fourth abrasive sharpening surface at a location spaced from a perimeter of the fourth abrasive sharpening surface.

22. The blade sharpening device of claim 21, wherein the first and third abrasive sharpening surfaces are arranged to pivot conjointly about the pivot connection with the first support, and wherein the second and fourth abrasive sharpening surfaces are arranged to pivot conjointly about the pivot connection with the second support.

23. The blade sharpening device of claim 21, wherein the first and second supports are pivotable about the pivot connection to change from the operational arrangement to a stowed arrangement, the first and second supports extending alongside one another in the stowed arrangement.

24. The blade sharpening device of claim 23, wherein the first ends of the first and second supports are adjacent to one another when the first and second supports are in the stowed arrangement and the second ends of the first and second supports are adjacent to one another when the first and second supports are in the stowed arrangement.

25. The blade sharpening device of claim 24, wherein the first and second abrasive sharpening surfaces are in face-to-face engagement when the first and second supports are in the stowed arrangement.

26. The blade sharpening device of claim 23, wherein the first and second supports lie against one another when the first and second supports are in the stowed arrangement.

27. The blade sharpening device of claim 23, wherein, when the first and second supports are in the stowed arrangement, the first and second abrasive sharpening surfaces engage one another and the third and fourth abrasive sharpening surfaces engage one another.

28. The blade sharpening device of claim 21, further comprising a retainer arranged to retain the first and second supports in the operational arrangement.

29. The blade sharpening device of claim 21, further comprising a base having first and second receivers arranged to receive the second ends of the first and second supports when the first and second supports are in the operational arrangement and the first and second supports are in a first orientation relative to the base to support the first and second supports for use in sharpening the blade.

30. The blade sharpening device of claim 29, wherein the base has a third receiver, wherein the operational arrangement is a first operational arrangement, the first and second abrasive sharpening surfaces being spaced apart by a first angular distance about the pivot connection when the first and second supports are in the first operational arrangement, wherein the first and second supports are pivotable about the pivot connection to arrange the first and second supports in a second operational arrangement for use in sharpening the blade, the first and second abrasive sharpening surfaces being spaced apart by a second angular distance about the pivot connection when the first and second supports are in the second operational arrangement, the first angular distance being different than the second angular distance, and wherein the first and third receivers are arranged to receive the second ends of the first and second supports when the first and second supports are in the second operational arrangement to support the first and second supports for use in sharpening the blade.

31. The blade sharpening device of claim 29, wherein the first and second receivers are arranged to receive the first ends of the first and second supports when the first and second supports are in the operational arrangement and the first and second supports are in a second orientation relative to the base to support the first and second supports for use in sharpening the blade, the second orientation being inverted relative to the first orientation.

32. The blade sharpening device of claim 21, wherein the pivot connection directly connects the first and second supports to one another.

33. The blade sharpening device of claim 21, wherein the pivot connection forms a pivot axis about which the first and second supports pivot, the pivot axis intersecting a center of the X shape when the first and second supports are in the operational arrangement.

34. The blade sharpening device of claim 21, wherein in the operational arrangement the first and second abrasive sharpening surfaces are located directly across from one another and the third and fourth abrasive sharpening surfaces are located directly across from one another.

35. The blade sharpening device of claim 21, wherein the pivot connection includes a fastener having a head engaging the first support or the second support.

36. The blade sharpening device of claim 35, wherein the fastener is a first fastener and the head of the first fastener engages the first support, and wherein the pivot connection includes a second fastener having a head engaging the second support.

37. The blade sharpening device of claim 36, wherein the first and second fasteners are directly coupled to one another.

38. The blade sharpening device of claim 21, wherein the first and third abrasive sharpening surfaces are spaced apart from one another, and wherein the second and fourth abrasive sharpening surfaces are spaced apart from one another.

39. The blade sharpening device of claim 21, wherein the first, second, third, and fourth abrasive sharpening surfaces each have a radially inner edge and a radially outer edge spaced radially outward of the radially inner edge relative to the pivot connection, wherein when the first and second supports are in the operational arrangement the radially inner edges of the respective first, second, third, and fourth abrasive sharpening surfaces are each spaced radially outward and apart from the pivot connection.

40. A blade sharpening device for sharpening a blade, the sharpening device comprising:

a blade sharpening assembly comprising:

a first support having opposite first and second ends;

a second support having opposite first and second ends; and a pivot connection connecting the first and second supports, the pivot connection disposed between the first and second ends of the first support and between the first and second ends of the second support, the first and second supports being pivotable about the pivot connection to pivot the first and second supports relative to one another to arrange the first and second supports in an operational arrangement for use in sharpening the blade, wherein in the operational arrangement the first and second supports are arranged to form a generally X shape;

wherein the first support includes a first abrasive sharpening surface disposed between the pivot connection and the first end of the first support, and the second support includes a second abrasive sharpening surface disposed between the pivot connection and the first end of the second support, the first and second abrasive sharpening surfaces arranged to generally face one another when the first and second supports are in the operational arrangement; and a base configured to selectively receive and support the second ends of the first and second supports when the first and second supports are in the operational arrangement and the first and second supports are in a first orientation relative to the base to support the blade sharpening assembly for use in sharpening the blade;

wherein the pivot connection connects the first and second supports when the first and second supports are received by the base and when the first and second supports are not received by the base.

41. The blade sharpening device of claim 40, wherein the base includes a first receiver and a second receiver, the first receiver being arranged to receive the second end of the first support when the first and second supports are in the operational arrangement and the first and second supports are in the first orientation, the second receiver being arranged to receive the second end of the second support when the first and second supports are in the operational arrangement and the first and second supports are in the first orientation.

42. The blade sharpening device of claim 41, wherein the base has a third receiver, wherein the operational arrangement is a first operational arrangement, the first and second abrasive sharpening surfaces being spaced apart by a first angular distance about the pivot connection when the first and second supports are in the first operational arrangement, wherein the first and second supports are pivotable about the pivot connection to arrange the first and second supports in a second operational arrangement for use in sharpening the blade, the first and second abrasive sharpening surfaces being spaced apart by a second angular distance about the pivot connection when the first and second supports are in the second operational arrangement, the first angular distance being different than the second angular distance, and wherein the first and third receivers are arranged to receive the second ends of the first and second supports when the first and second supports are in the second operational arrangement to support the first and second supports for use in sharpening the blade.

43. The blade sharpening device of claim 40, wherein the first support includes a third abrasive sharpening surface disposed between the pivot connection and the second end of the first support, and the second support includes a fourth abrasive sharpening surface disposed between the pivot connection and the second end of the second support, the third and fourth abrasive sharpening surfaces arranged to generally face one another when the first and second supports are in the operational arrangement, and wherein the base is configured to selectively receive the first ends of the first and second supports when the first and second supports are in the operational arrangement and the first and second supports are in a second orientation relative to the base to support the blade sharpening assembly for use in sharpening the blade, the second orientation being inverted relative to the first orientation.

44. The blade sharpening device of claim 40, wherein the first and second supports are pivotable about the pivot connection to change from the operational arrangement to a stowed arrangement; and wherein the base includes an interior and an opening permitting access to the interior, the blade sharpening assembly being receivable in the interior of the base via insertion into the opening when the first and second supports are in the stowed arrangement.

45. The blade sharpening device of claim 40, wherein the base is configured to engage the second ends of the first and second supports when the first and second supports are in the operational arrangement and the first and second supports are in a first orientation relative to the base to support the blade sharpening assembly for use in sharpening the blade.

* * * * *